US006419385B1

(12) United States Patent
Walls

(10) Patent No.: US 6,419,385 B1
(45) Date of Patent: Jul. 16, 2002

(54) HAND PAINT MIXER

(76) Inventor: Jason Walls, 397 Cook Ave., Danville, IN (US) 46122

( * ) Notice: Subject to any disclaimer, the term of this patent is extended or adjusted under 35 U.S.C. 154(b) by 0 days.

(21) Appl. No.: 09/692,277

(22) Filed: Oct. 19, 2000

(51) Int. Cl.[7] ..... B01F 7/18

(52) U.S. Cl. ..... 366/247; 366/308; 366/605; 366/347

(58) Field of Search ..... 366/247, 248, 366/244, 245, 246, 249, 250, 251, 252, 605, 308, 285, 343, 342, 347

(56) References Cited

U.S. PATENT DOCUMENTS

| | | | | |
|---|---|---|---|---|
| 1,133,413 A | | 3/1915 | Stough | |
| 1,447,653 A | | 3/1923 | Fish | 366/308 |
| 1,734,120 A | * | 11/1929 | Farrington | 366/308 |
| 2,027,297 A | | 1/1936 | Tramposch | |
| 2,123,600 A | * | 7/1938 | Galante | 366/247 |
| 2,130,542 A | * | 9/1938 | Giddings | 366/308 |
| 2,269,736 A | * | 1/1942 | Rogers | 366/247 |
| 2,585,334 A | | 2/1952 | McCauley | 220/55 |
| 2,898,094 A | | 8/1959 | O'Neill, Jr. | |
| 3,162,338 A | | 12/1964 | Grubelic | 222/484 |
| 3,175,808 A | | 3/1965 | Dedoes | |
| 3,520,519 A | | 7/1970 | Cross | |
| 3,641,615 A | | 2/1972 | Peasley | 220/700 X |
| 3,704,007 A | | 11/1972 | Kroeger | |
| 3,744,767 A | | 7/1973 | Blasnik | |
| 4,050,678 A | | 9/1977 | Smith | 366/130 |
| 4,083,653 A | * | 4/1978 | Stiffler | 366/308 |
| 4,339,992 A | | 7/1982 | Kurland | 99/348 |
| 4,380,399 A | | 4/1983 | Godat et al. | 366/289 |
| 4,422,770 A | | 12/1983 | Geible | 366/248 |
| 4,472,063 A | | 9/1984 | Eickelmann | 366/129 |
| 4,926,390 A | | 5/1990 | Murzsa | 366/249 |
| D320,938 S | | 10/1991 | Stallings | D9/436 |
| 5,094,543 A | | 3/1992 | Mursa | 366/247 |
| D327,015 S | | 6/1992 | Stallings | D9/436 |
| 5,199,788 A | * | 4/1993 | Stallings | 366/247 |
| 5,251,979 A | | 10/1993 | Larsen | 366/248 |
| 5,407,270 A | | 4/1995 | Barile et al. | 366/347 |
| 5,533,802 A | * | 7/1996 | Garganese | 366/605 |
| 5,676,463 A | * | 10/1997 | Larsen | 366/605 |
| 5,857,772 A | | 1/1999 | Washington | 366/243 |

* cited by examiner

*Primary Examiner*—Tony G. Soohoo
(74) *Attorney, Agent, or Firm*—William F. Bahret

(57) ABSTRACT

A hand paint mixer having a one-piece lid with integral spout, vent and release tab, a one-piece shaft with integral hand crank, and a one-piece impeller having elongated Z-shaped blades. The Z-shaped blades are pivotally connected to the lower end of the shaft and have a common bottom edge of width greater than the diameter of the opening in the paint can in which the mixer is designed to be used.

21 Claims, 8 Drawing Sheets

HAND PAINT MIXER

This invention relates generally to painting accessories and, more particularly, to manually operated paint mixers of the type used to mix paint in a conventional paint can.

Mixing paint in the conventional can in which it is sold at the retail level is a routine practice immediately prior to use. While a great variety of manually operated and electrically powered mixing devices have been proposed and/or used over the years, the most common such device in used today remains the simple hand stirring stick or paddle, in spite of the well known fact that this most basic method is not only time-consuming and tiresome but can easily lead to spillage and incomplete paint mixing. The shaker-type mixing machines found in paint and hardware stores are impractical for field use, of course, and all electrically powered mixing devices, such as the type driven by a portable electric drill, are unusable at work sites where there is no electricity. Examples of power-driven mixers are found in the following patents:

| U.S. Pat. No. | Inventor | Issue Date |
|---|---|---|
| 3,162,338 | Grubelic | Dec. 22, 1964 |
| 3,175,808 | Dedoes | Mar. 30, 1965 |
| 4,339,992 | Kurland | Jul. 20, 1982 |
| 4,380,399 | Godat et al. | Apr. 19, 1983 |
| 4,422,770 | Geible | Dec. 27, 1983 |
| 4,472,063 | Eickelmann | Sep. 18, 1984 |
| 4,926,390 | Murzsa | May 15, 1990 |
| 5,251,979 | Larsen | Oct. 12, 1993 |

Some mixers, such as that disclosed in the above-referenced U.S. Pat. No. 4,472,063 to Eickelmann, are mounted in the chuck of an electric drill and guided entirely by hand in an uncovered paint can. This can lead to spillage as with the simple stirring stick and, worse, can result in splashing of paint onto the user and elsewhere.

Examples of the hand-operated mixers that have been proposed over the years are found in the following patents:

| U.S. Pat. No. | Inventor | Issue Date |
|---|---|---|
| 1,447,653 | Fish | Mar. 6, 1923 |
| 2,027,297 | Tramposch | Jan. 7, 1936 |
| 2,898,094 | O'Neill, Jr. | Aug. 4, 1959 |
| 3,704,007 | Kroeger | Nov. 28, 1972 |
| D320,938 | Stallings | Oct . 22, 1991 |
| 5,857,772 | Washington | Jan. 12, 1999 |

While ostensibly offering advantages of hand tools such as simplicity and low cost, the prior art hand mixers are often overly complex and expensive and/or difficult to set up, use or clean, or not as efficient or effective as desired.

SUMMARY OF THE INVENTION

The present invention overcomes these and other disadvantages of the prior art with a hand paint mixer comprising, in one embodiment, a circular lid adapted to cover the opening of the paint can, a shaft rotatably mounted to the lid, a hand crank on the upper end of the shaft, and a plurality of Z-shaped blades mounted on the lower end of shaft, the blades each including top and bottom transverse members interconnected by a diagonal member. The bottom transverse members are each attached at one end to the shaft and the top transverse members and diagonal members are spaced from the shaft.

According to another aspect of the present invention, the hand mixer includes a circular lid, a shaft rotatably mounted to the lid, a hand crank on the upper end of the shaft, and a pair of diametrically opposed blades mounted on the lower end of the shaft and extending longitudinally more than half the length thereof, the blades each including a bottom portion having a width nearly equal to the radius of the paint can and further including a relatively narrow portion above the bottom portion. The blades are pivotally connected to the lower end of the shaft for upward pivoting of one of them relative to the other during insertion and removal thereof.

According to another aspect of the present invention, the hand mixer includes a one-piece, snap-on plastic lid with an integral spout and vent, a one-piece shaft with an integral hand crank, and a one-piece, plastic impeller including a plurality of blades. The shaft is rotatably and slidably mounted in a bearing in the lid and has the hand crank integrally formed on its upper end, the crank including a transverse segment and an upwardly extending segment.

It is a general object of the present invention to provide improvements in paint mixers.

A more specific object of the invention is to provide an improved blade shape for a hand paint mixer.

Another object of the invention is to facilitate widespread mixing of paint, particularly at the bottom of the can, with a simple hand tool that is easily inserted and removed.

A further object of the invention is to provide a hand paint mixer of simple construction, low parts count, and low cost.

Yet another object is to provide a hand tool that enables rapid and effective mixing and is easy to set up, use and clean.

These and other advantages of the present invention will be apparent upon reading the following detailed description in conjunction with the accompanying drawings.

DETAILED DESCRIPTION OF THE PREFERRED EMBODIMENT

Figure 1:
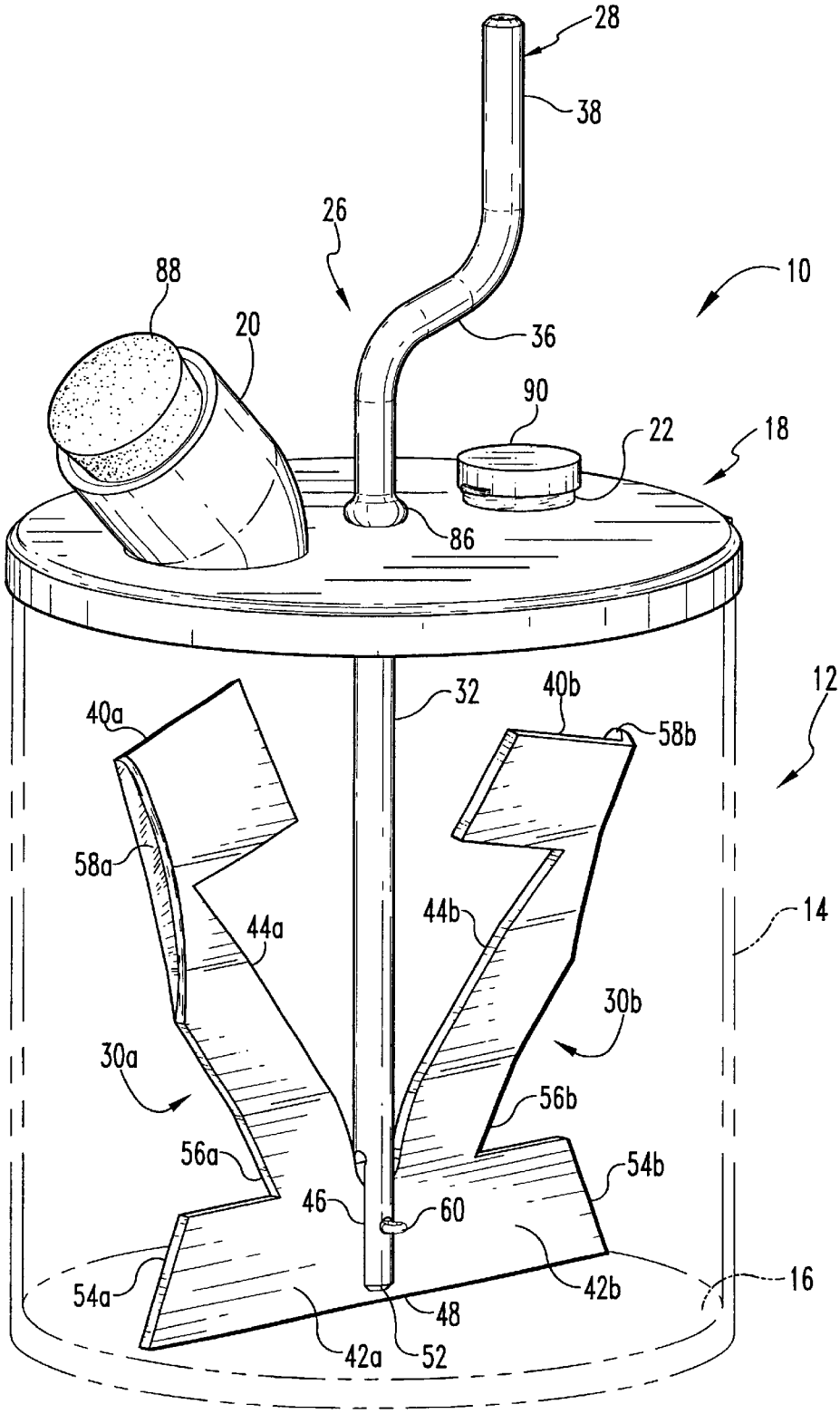
FIG. 1 is a perspective view of the preferred embodiment of a hand paint mixer according to the present invention in a conventional paint can which is shown in phantom for purposes of illustration.
Figure 2:
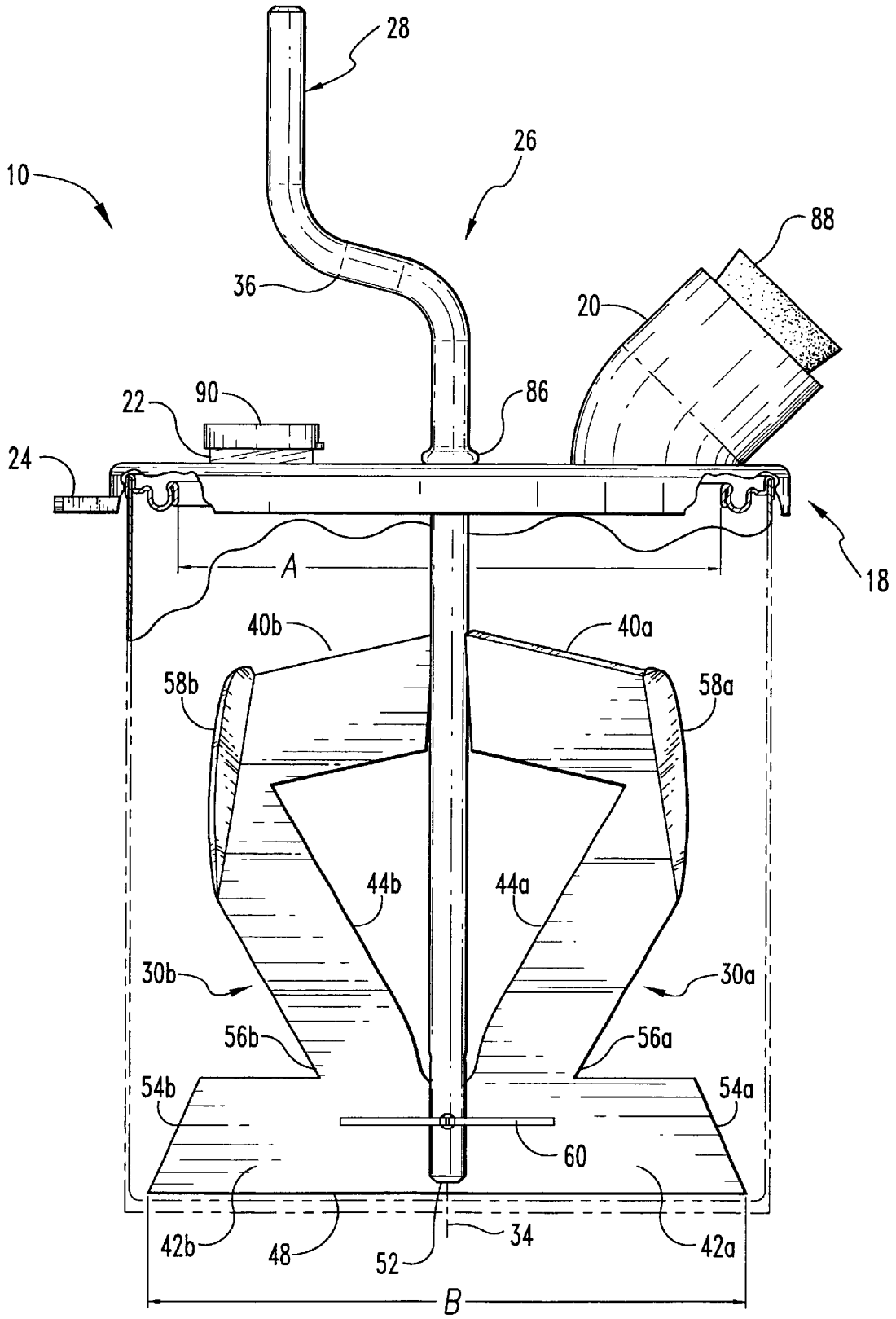
FIG. 2 is a front view of the paint mixer of FIG. 1.
Figure 3:
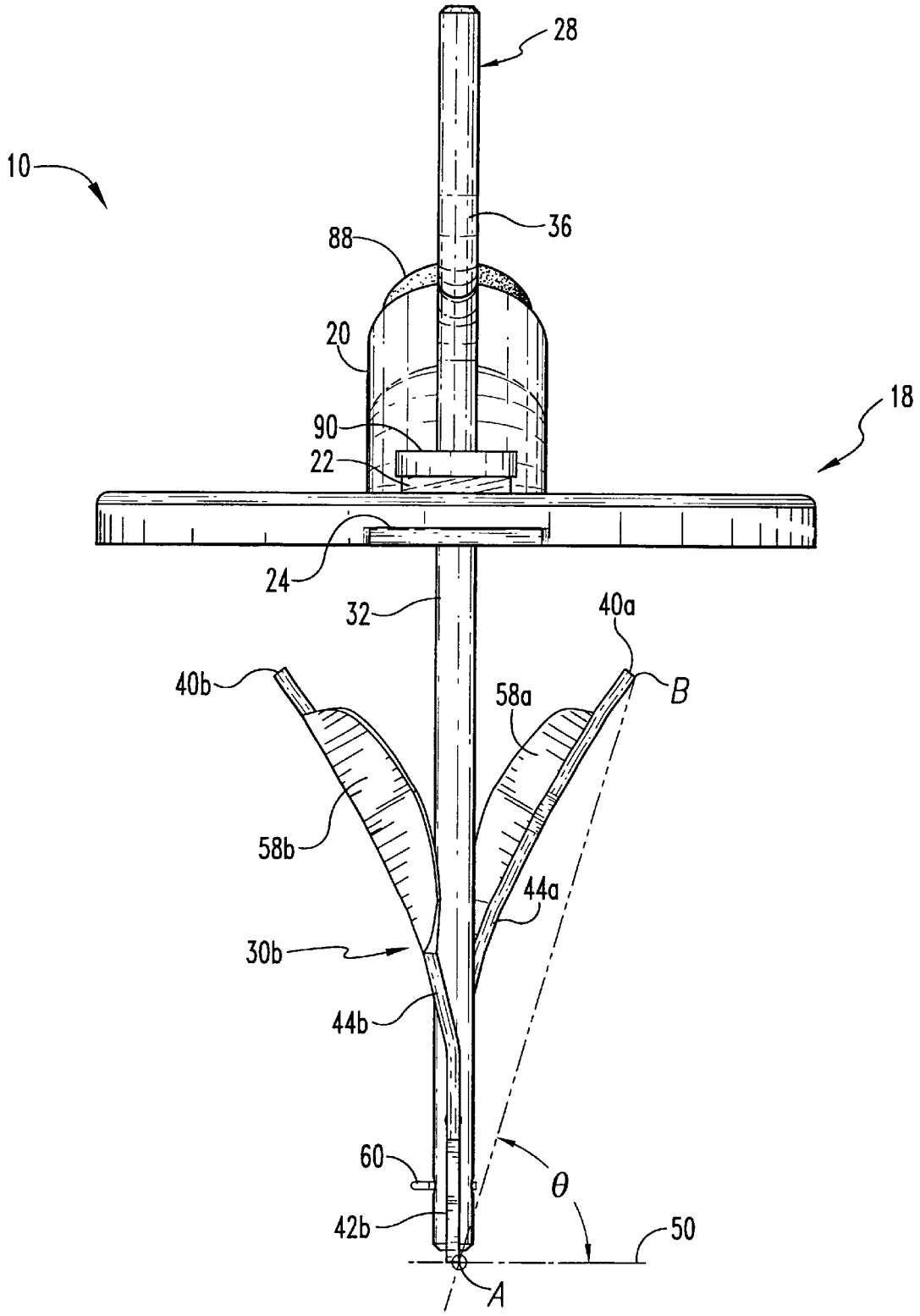
FIG. 3 is a side view of the paint mixer of FIG. 1.
Figure 4:
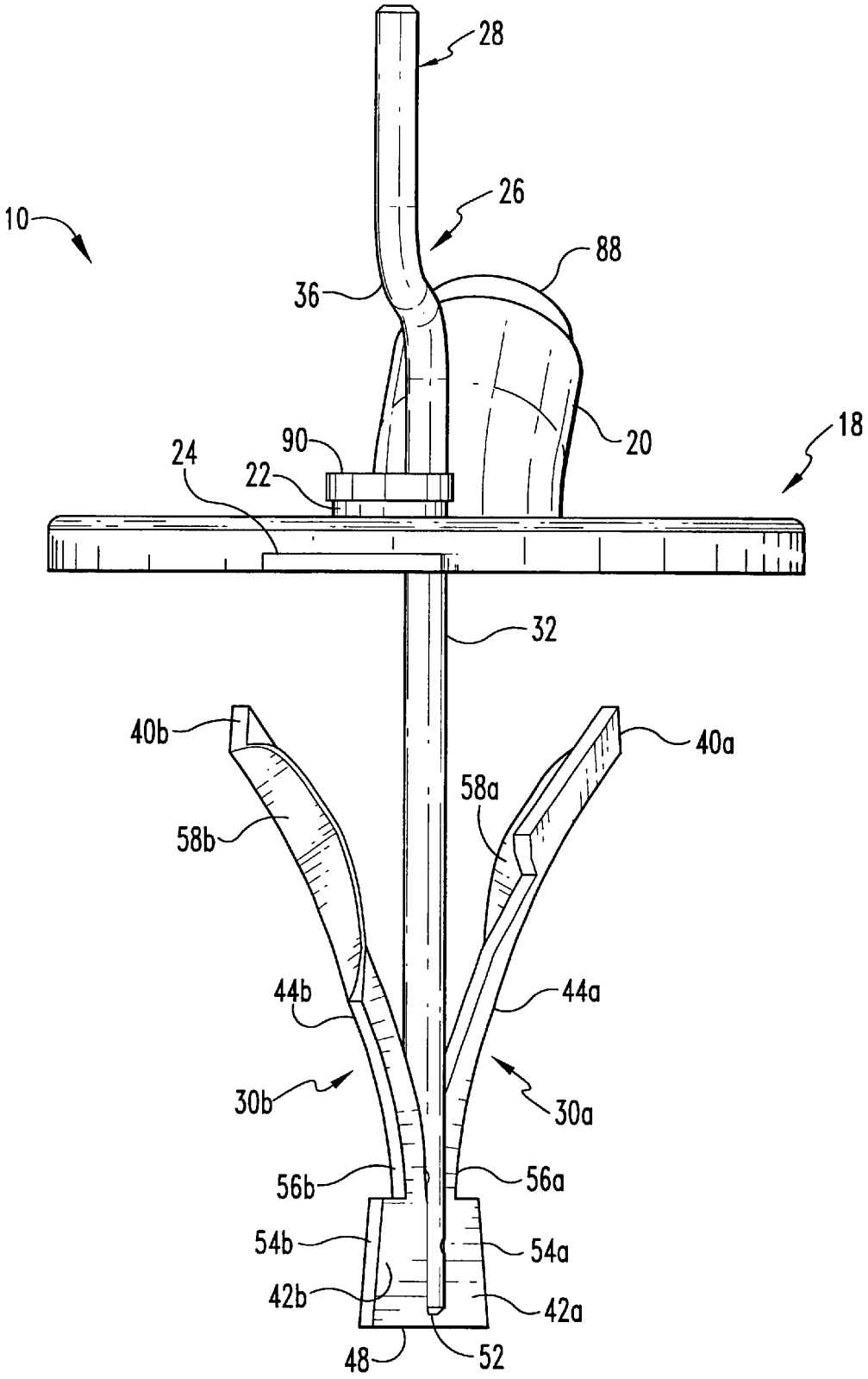
FIG. 4 is an auxiliary side view of the paint mixer of FIG. 1 from an angle approximately 10° counter-clockwise from that of FIG. 3.
Figure 5:
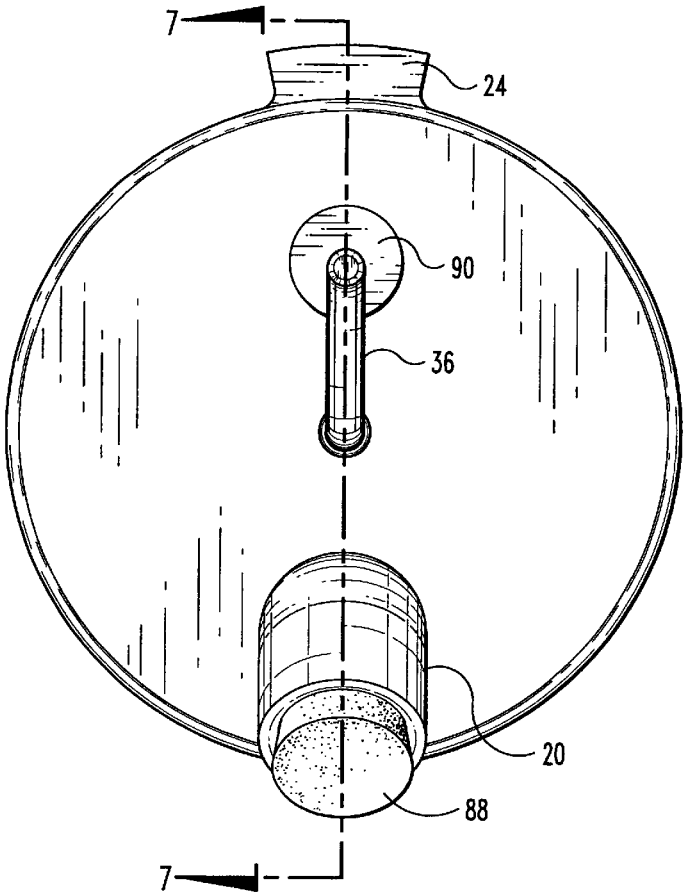
FIG. 5 is a top view of the paint mixer of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIG. 1 illustrates a hand paint mixer 10 according to the present invention installed on a conventional one-gallon paint can 12 having a hollow cylindrical main body 14 and a flat bottom wall 16. Referring also to FIGS. 2–6, the paint mixer includes a one-piece lid 18 having an integral spout 20, vent 22 and release tab 24, a one-piece shaft 26 having an integral hand crank 28, and a one-piece impeller having elongated Z-shaped blades 30*a* and 30*b*. The lid is preferably molded of plastic, e.g., PVC, and adapted to snap onto the top of an open can and seal the opening thereof, as will be described in further detail below. The shaft may be made of metal or rigid plastic. It has a straight lower end 32 that is coaxial with the longitudinal axis 34 of the paint can, and its upper end is bent, molded or otherwise formed to provide a transverse segment 36 and an upwardly extending segment 38 which together define the integral hand crank. The shaft is rotatably and slidably mounted in a vertically oriented bearing 38, of slightly greater diameter than the shaft, that is integrally formed in the center of the lid as best shown in FIG. 7.

Z-shaped blades 30*a,b* include respective top transverse members 40*a,b* and bottom transverse members 42*a,b* interconnected by respective diagonal members 44*a,b*. The bottom transverse members are integrally joined and are pivotally connected at their junction 46 to the lower end of the shaft as shown in the drawings. The shaft is slotted for this purpose. The two bottom members have a common bottom edge 48 and, as perhaps best shown in FIG. 3, lie in a common vertical plane from which the diagonal members curve outwardly. The blade pitch, defined as the angle θ that the chord AB makes with the plane 50 perpendicular to the longitudinal axis 34 of the shaft, is preferably steep, i.e., an angle greater than 60°. The pitch is more preferably in the range of 60–80°, and most preferably in the range of 70–75°.

The blades preferably extend longitudinally more than half the length of the lower end of the shaft and have a width nearly equal to the radius of the paint can. For example, for a one-gallon paint can approximately 7.5" high and approximately 6.5" in diameter, with an opening approximately 6" in diameter (dimension A), the vertical height of each blade is at least 4", and more preferably approximately 5.5", and the bottom member of each blade is preferably 3⅛" wide at the common bottom edge 48. That is, the width of the common edge 48 is preferably 6¼" (dimension B), and thus greater than the diameter of the opening. Common edge 48 may be virtually as wide as the interior of the can, although a minor clearance is desirable. For a quart can approximately 5" high and 4¼" in diameter, with a 3⅞" opening, common edge 48 is preferably 4" wide. Again, dimension B is preferably greater than dimension A. The blades may be stamped out of a single flat sheet of plastic, e.g., PVC, and bent into the illustrated shape or may be molded or otherwise directly formed in the illustrated shape. A thickness of ⅛" is suitable for the blades.

Common bottom edge 48 is preferably flat and located entirely below the tip 52 of the shaft as shown, and the shaft is preferably sized and vertically constrained such that the bottom edge is closely adjacent to the bottom wall of the can. With the width of the bottom edge nearly equal to the diameter of the can, the bottom member of each blade sweeps virtually the entire bottom wall surface on each revolution and thereby stirs up any sediment at the bottom of the can, including sediment in the corner between the side and bottom walls. The overall construction of the steeply pitched blades is such that the blades directly act on the paint at nearly all levels within the can and enable rapid and if, thorough mixing thereof.

The bottom members include tapered outer edges 54*a,b,* and the blades include substantially narrower portions 56*a,b* above the bottom members, e.g., at the bottom of each diagonal member. The width of each blade everywhere above the bottom members is less than the radius of the opening in the can. The diagonal members and top transverse members share flared segments 58*a,b* as shown. The blades are pivotally connected to the shaft by a cotter pin 60 or other pivot pin extending through respective holes provided for this purpose in the lower end of the shaft and the junction of the bottom members. To further reduce the parts count, a pair of pivot pins may be integrally formed on the facing surfaces of the slot in the shaft or on the junction of the bottom members, and a mating pair of holes or indentations may be integrally formed in the part not provided with pins, the pins and holes or indentations being sized and shaped to provide a secure snap fit connection. The pivotal connection and the above-described blade shape cooperate to facilitate insertion of the blades into the can and removal of the blades therefrom, as will be described.

Figure 6:
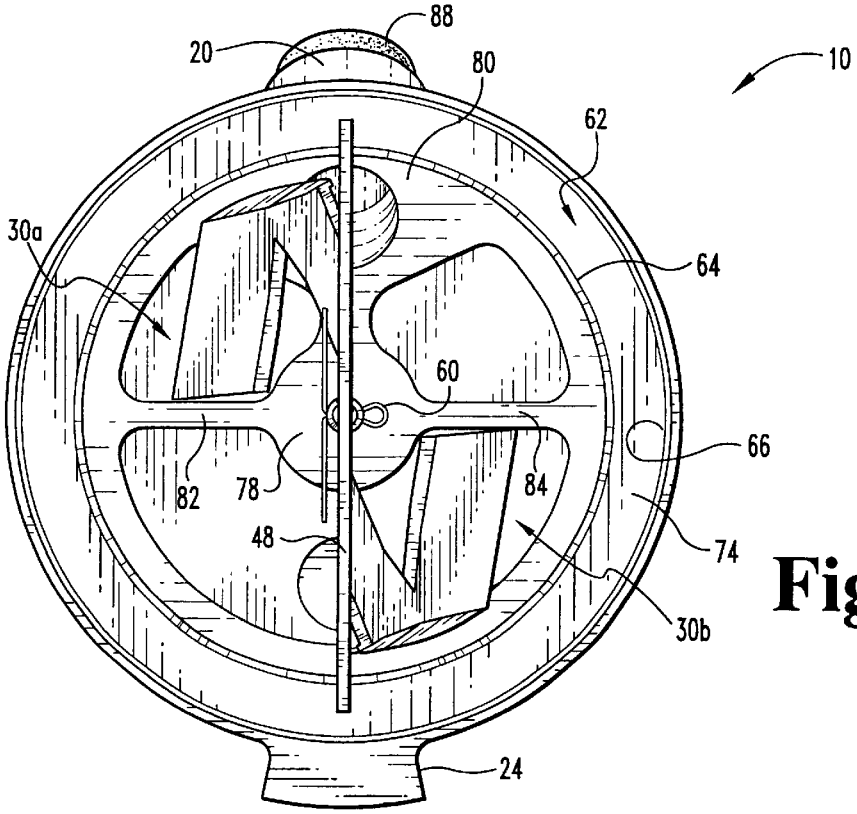
FIG. 6 is a bottom view of the paint mixer of FIG. 1.
Figure 7:
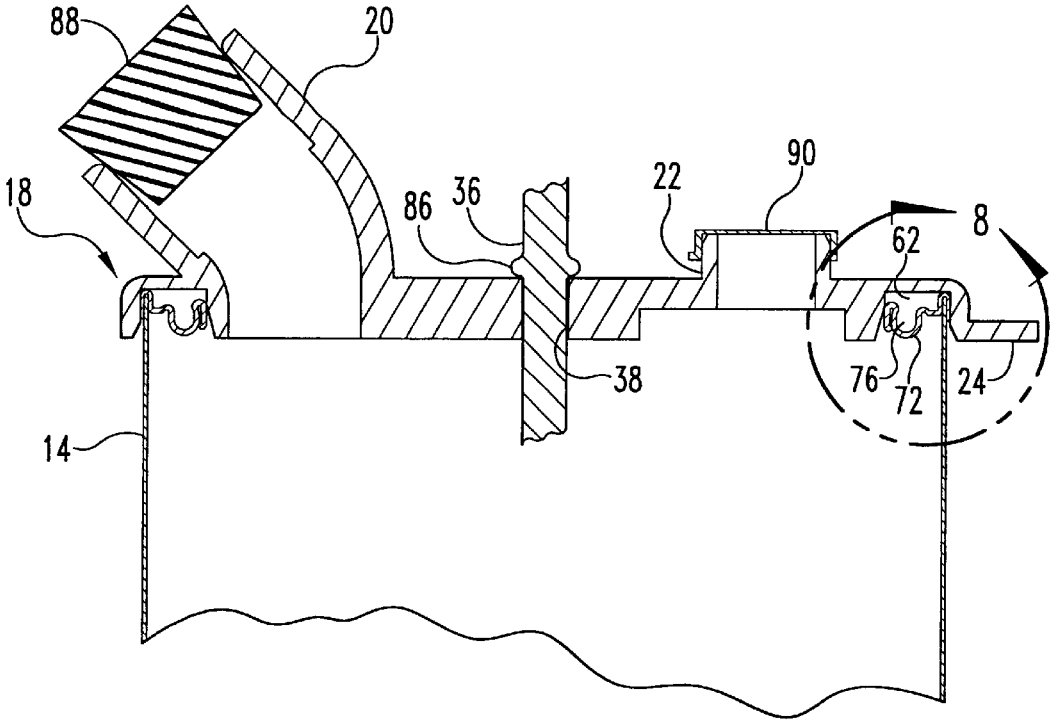
FIG. 7 is a cross-section of the upper portion of the paint mixer of FIG. 1, taken along lines 7—7 in FIG. 5.
Figure 8:
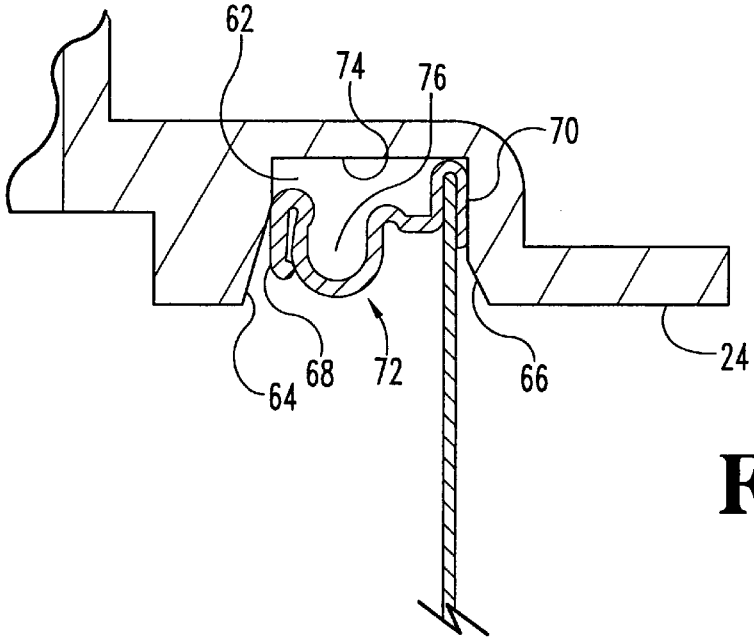
FIG. 8 is an enlarged view of the portion of the paint mixer identified by circular line 8 in FIG. 7.

Referring now to FIGS. 6–8, the lid is molded such that its underside defines an annular peripheral groove 62 having concentric, partially tapered inner and outer side walls 64 and 66 sealingly engaging respective inner and outer walls 68 and 70 of the lip 72 on the top of the can, and an upper wall 74 lying over the groove 76 in the lip. The inner side wall of peripheral groove 62 seals off groove 76 externally, i.e., without filling the groove, and thereby effectively prevents any paint from reaching the top of inner wall 68 and thence entering groove 76. This construction helps keep groove 76 paint-free, as is desirable, and is an improvement in this regard over constructions in which the groove is simply plugged from above. The lid is approximately 0.5" thick at the side walls of groove 62 and in the area adjacent to the groove, and may be approximately 0.1" thick in the center of the groove. The center 78 of the lid and the area 80 around spout 20 are also 0.5" thick for reinforcement purposes, and ribs 82 and 84 of the same thickness are also provided for further reinforcement. The remainder of the lid radially inward of the groove 62 may be approximately 0.1–0.25" thick or thicker, although the weight and cost of material tend to rise with increased thickness.

The downward axial motion of the shaft may be limited by means of a boss 86 integrally formed on the shaft at a desired position such as that shown, whereby bottom edge 46 is closely adjacent to the bottom wall of the can An annular boss is preferred, although a single-point projection or diametrically opposed projections, for example, would also be suitable. The shaft diameter is otherwise uniform such that the shaft can be inserted through the bearing in the lid and removed therefrom when the blades are not attached. Alternatively, a lock washer may be located at a desired position on a shaft of uniform diameter as a vertical constraint.

With the disclosed construction, the paint mixer is easy to set up, use and clean. It may be compactly packaged in unassembled form for ease of shipment and sale. The user can easily assemble the mixer by inserting the lower end of the shaft through the lid and then attaching the blades to the shaft. For insertion of the blades into a paint can, the user simply pivots one blade downwardly relative to the other, inserts the bottom member of that blade, e.g., blade 30*a*, through the opening in the can and places the associated narrow portion 56*a* next to the lip on the can, and then pivots the other blade downwardly such that its bottom member passes through the opening in the can, after which the blades can be lowered straight into the can and the lid can be snapped onto the top of the can. With the mixer so installed, simple manual rotation of the integral handle produces rapid and thorough mixing. Removal of the mixer from the can is a simple matter of pulling on the release tab to pull the lid off the top of the can, and then reversing the steps described above with respect to pivoting and insertion of the blades. The mixer is easily disassembled for cleaning, for example, by disconnecting the blades from the shaft and then sliding the shaft upwardly through the lid.

The mixer need not be removed after each use, and in fact is desirably left installed in a paint can after mixing to facilitate pouring operations, and also during subsequent storage if paint remains in the can after painting operations. Integral spout 20 advantageously extends upwardly and outwardly from the surface of the lid, e.g., at a 45° angle as shown, in order to reduce the possibility of dripping of paint onto the lid itself and down the side of the can. To seal the spout and vent during mixing operations and storage, a rubber stopper 88 or a cork may be provided in the spout and a cap 90 may be provided on the vent. A rotary grip (not shown) is optionally provided on segment 38 of the handle to facilitate manual operation.

Figure 9:
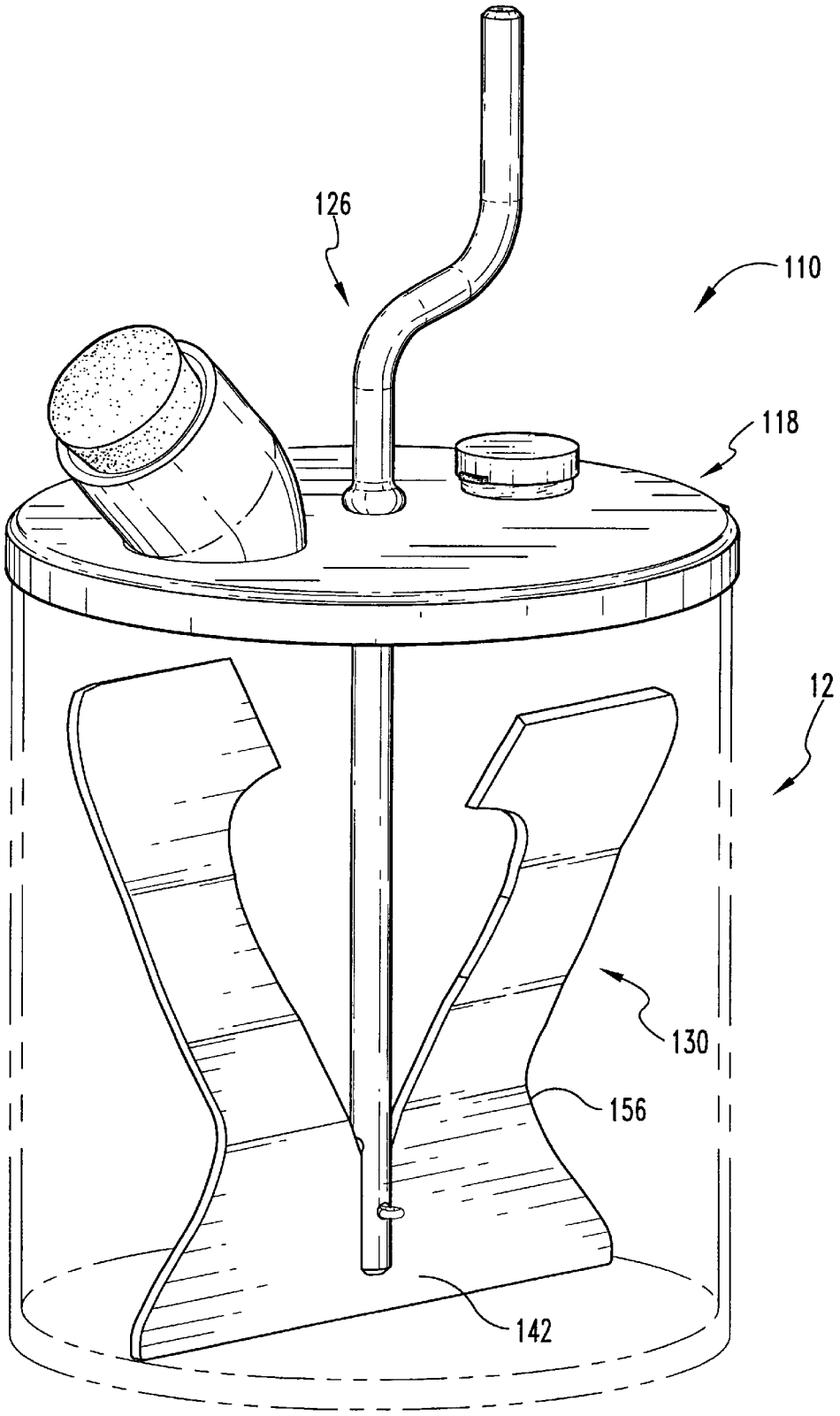
FIG. 9 is a perspective view of an alternative embodiment of a hand paint mixer according to the present invention in a conventional paint can which is shown in phantom for purposes of illustration.
Figure 10:
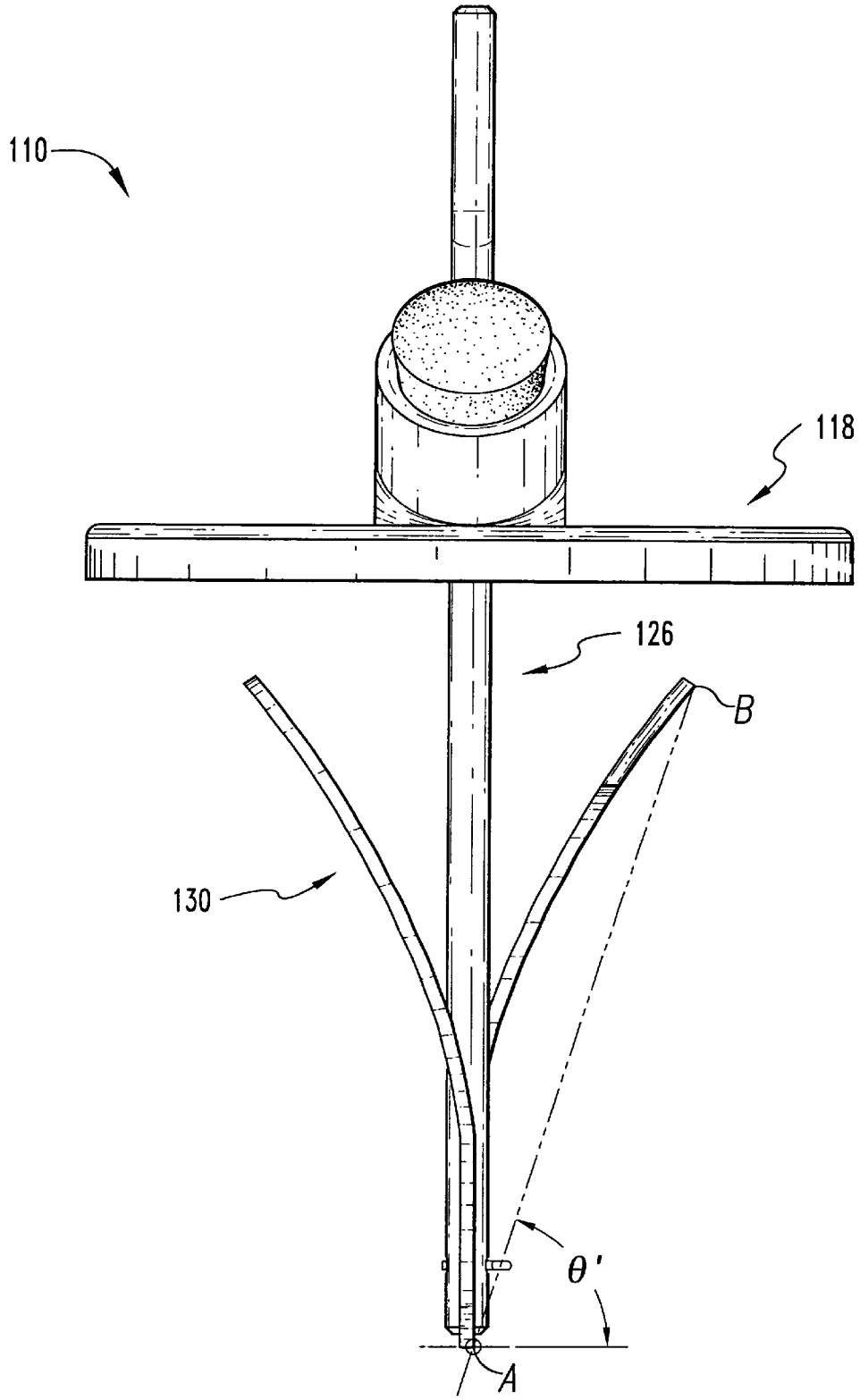
FIG. 10 is a side view of the paint mixer of FIG. 9.

Turning to FIGS. 9 and 10, an alternative embodiment of a hand paint mixer 110 according to the present invention has a lid 118 and a shaft 126 which may be identical to those described above, and an impeller 130 with a pair of blades shaped as illustrated in the drawings. A common planar member 142 is preferably wider than the opening in the can 12, as with the embodiment described above, and impeller 130 is similarly provided with narrower portions 156 above member 142. The pitch of the blades (angle θ') is preferably the same as in the embodiment described above, as are the blade height, thickness and bottom edge width. The blades are shown as smoothly curved above the common member 142, but a segmented curve may suffice for some applications.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A hand mixer for mixing paint in a paint can having a hollow cylindrical main body and a flat bottom wall, comprising:

a circular lid adapted to cover the opening of the paint can;

a shaft rotatably mounted to said lid, said shaft having upper and lower ends respectively above and below said lid;

a hand crank on said upper end of said shaft; and a plurality of Z-shaped blades mounted on said lower end of said shaft, said blades each including top and bottom transverse members interconnected by a diagonal member, said bottom transverse members each attached at one end to said shaft, said top transverse members and said diagonal members spaced from said shaft.

2. The hand mixer of claim 1, wherein each diagonal member is connected to its respective bottom transverse member at said one end thereof attached to said shaft.

3. The hand mixer of claim 2, wherein said blades have a 60–80° pitch.

4. The hand mixer of claim 3, wherein said blades extend more than four inches upwardly along the axis of said shaft.

5. The hand mixer of claim 4, wherein the pitch of said blades is approximately 70–75°.

6. The hand mixer of claim 5, wherein said bottom transverse members each have a broad surface, and wherein said blades are pivotally connected to said shaft on an axis perpendicular to at least one of said broad surfaces.

7. The hand mixer of claim 6, wherein said bottom transverse members each have a bottom edge parallel and closely adjacent to the flat bottom wall of the paint can when said blades are mounted therein.

8. The hand mixer of claim 1, wherein said blades have a 60–80° pitch.

9. The hand mixer of claim 1, wherein said bottom transverse members each have a broad surface, and wherein said blades are pivotally connected to said shaft on an axis perpendicular to at least one of said broad surfaces.

10. The hand mixer of claim 1, wherein said bottom transverse members each have a bottom edge parallel and closely adjacent to the flat bottom wall of the paint can when said blades are mounted therein.

11. A hand mixer for mixing paint in a paint can having a hollow cylindrical main body and a flat bottom wall, comprising:

a circular lid adapted to cover the opening of the paint can;

a shaft rotatably mounted to said lid, said shaft having upper and lower ends respectively above and below said lid;

a hand crank on said upper end of said shaft; and a pair of diametrically opposed blades mounted on said lower end of said shaft and extending longitudinally more than half the length thereof, said blades each including a bottom portion having a width nearly equal to the radius of the paint can and further including a relatively narrow portion above said bottom portion, said blades being pivotally connected to said lower end of said shaft for upward pivoting of one of said blades relative to the other during insertion and removal thereof, wherein said blades diverge upwardly from said shaft.

12. The hand mixer of claim 11, wherein said blades have a 60–80° pitch.

13. The hand mixer of claim 12, wherein the pitch of said blades is approximately 70–75°.

14. The hand mixer of claim 13, herein said bottom portions of said blades are coplanar.

15. The hand mixer of claim 14, wherein said bottom portions each have a bottom edge parallel and closely adjacent to the flat bottom wall of the paint can when said blades are positioned therein.

16. A hand mixer for mixing paint in a paint can having a hollow cylindrical main body and a flat bottom wall, comprising:

a circular lid adapted to cover the opening of the paint can;

a shaft rotatably mounted to said lid, said shaft having upper and lower ends respectively above and below said lid;

a hand crank on said upper end of said shaft; and a pair of diametrically opposed blades mounted on said lower end of said shaft and extending longitudinally more than half the length thereof, said blades each including a bottom portion having a width nearly equal to the radius of the paint can and further including a relatively narrow portion above said bottom portion, said blades being pivotally connected to said lower end of said shaft for upward pivoting of one of said blades relative to the other during insertion and removal thereof, wherein said blades have a 60–80° pitch.

17. A hand mixer for mixing paint in a paint can having a hollow cylindrical main body and a flat bottom wall, comprising:

a circular lid adapted to cover the opening of the paint can;

a shaft rotatably mounted to said lid, said shaft having upper and lower ends respectively above and below said lid;

a hand crank on said upper end of said shaft; and a pair of diametrically opposed blades mounted on said lower end of said shaft and extending longitudinally more than half the length thereof, said blades each including a bottom portion having a width nearly equal to the radius of the paint can and further including a relatively narrow portion above said bottom portion, said blades being pivotally connected to said lower end of said shaft for upward pivoting of one of said blades relative to the other during insertion and removal thereof, wherein said bottom portions each have a bottom edge parallel and closely adjacent to the flat bottom wall of the paint can when said blades are positioned therein.

18. A hand mixer for mixing paint in a paint can having a hollow cylindrical main body and an open top including a lip with a groove therein, comprising:

a one-piece, plastic lid adapted to snap onto the top of an open paint can, said lid including a central, vertically oriented bearing, said lid further including an integral peripheral spout and an integral vent;

a one-piece shaft rotatably and slidably mounted in said bearing in said lid, said shaft having upper and lower ends respectively above and below said lid, said upper end of said shaft having an integrally formed hand crank including a transverse segment and an upwardly extending segment; and a one-piece, plastic impeller mounted on said lower end of said shaft, said impeller including a plurality of blades;

wherein said upper end of said one-piece shaft includes means integrally formed thereon below said hand crank for limiting downward axial motion of said shaft in said bearing;

wherein said one-piece impeller is readily attachable to and removable from said lower end of said shaft, and wherein said lower end of said shaft is readily insertable and removable through said bearing when said impeller is removed, whereby said lid, shaft and impeller may be compactly packaged in unassembled form and easily assembled by the user and also easily disassembled by the user for cleaning; and wherein said impeller has a width nearly equal to the diameter of the paint can and is pivotally connected to said lower end of said shaft for upward pivoting of one of said blades relative to the other to facilitate insertion of said impeller into the paint can and removal therefrom.

19. The hand mixer of claim 18, wherein said one-piece lid includes means integrally formed thereon for sealingly engaging the radially innermost surface of the lip on the top of the can and thereby externally sealing off the groove in the lip during paint mixing.

20. A hand mixer for mixing paint in a paint can having a hollow cylindrical main body and an open top including a lip with a groove therein, comprising:

a one-piece, plastic lid adapted to snap onto the top of an open paint can, said lid including a central, vertically oriented bearing, said lid further including an integral peripheral spout and an integral vent;

a one-piece shaft rotatably and slidably mounted in said bearing in said lid, said shaft having upper and lower ends respectively above and below said lid, said upper end of said shaft having an integrally formed hand crank including a transverse segment and an upwardly extending segment; and a one-piece, plastic impeller mounted on said lower end of said shaft, said impeller including a plurality of blades, wherein said impeller has a width nearly equal to the diameter of the paint can and is pivotally connected to said lower end of said shaft for upward pivoting of one of said blades relative to the other to facilitate insertion of said impeller into the paint can and removal therefrom.

21. A hand mixer for mixing paint in a paint can having a hollow cylindrical main body, a flat bottom wall, and an open top including a lip with a groove therein, comprising:

a one-piece, plastic lid adapted to snap onto the top of an open paint can, said lid including a central, vertically oriented bearing, said lid further including an integral peripheral spout, an integral vent, and an underside defining an annular peripheral groove having concentric inner and outer side walls sealingly engaging respective inner and outer walls of the lip on the top of the can, and an upper wall lying over the groove in the lip, said lid further including an integral release tab;

a one-piece shaft rotatably and slidably mounted in said bearing in said lid, said shaft having a bent upper end and a straight lower end respectively above and below said lid, said bent upper end defining a hand crank including a transverse segment and an upwardly extending segment, said straight lower end having a uniform diameter slightly less than that of said bearing to facilitate insertion and removal of said shaft;

a one-piece, plastic impeller pivotally mounted on said lower end of said shaft, said impeller including a matched pair of blades having a common vertically oriented planar base member having a width nearly equal to the diameter of the paint can, said blades each including a top transverse member and a diagonal member interconnecting said top transverse member and said common base member;

means for sealing said spout;

means for sealing said vent;

means for limiting downward axial motion of said shaft in said bearing; and a pivot pin extending through said lower end of said shaft and said common base member of said impeller.

* * * * *